US005421553A

United States Patent [19]

Hashiue

[11] Patent Number: 5,421,553

[45] Date of Patent: Jun. 6, 1995

[54] LEVER-TYPE WINCH IDLER DEVICE

[75] Inventor: Kentaro Hashiue, Neyagawa, Japan

[73] Assignee: Kabushiki Kaisha Futaba Mfg., Japan

[21] Appl. No.: 128,107

[22] Filed: Sep. 29, 1993

[30] Foreign Application Priority Data

Mar. 17, 1993 [JP] Japan ..... 5-098997

[51] Int. Cl.[6] ..... B66D 1/14

[52] U.S. Cl. ..... 254/346; 254/352; 254/357

[58] Field of Search ..... 254/346, 352, 369, 353, 254/357; 192/43.1, 93 A, 20, 21, 95

[56] References Cited

U.S. PATENT DOCUMENTS

| | | | |
|---|---|---|---|
| 1,876,954 | 9/1932 | Johnson | 254/369 |
| 2,967,046 | 1/1961 | Ratcliff | 254/369 |
| 4,463,933 | 8/1984 | Schreyer et al. | 254/369 |
| 4,768,754 | 9/1988 | Nishimura | 254/352 |
| 5,156,377 | 10/1992 | Nishimura | 254/352 |
| 5,238,226 | 8/1993 | Nishimura | 254/352 |
| 5,305,989 | 4/1994 | Nishi et al. | 254/352 |

FOREIGN PATENT DOCUMENTS

| | | |
|---|---|---|
| 56-40786 | 9/1981 | Japan . |
| 57-24320 | 5/1982 | Japan . |

*Primary Examiner*—John M. Jillions
*Attorney, Agent, or Firm*—Sixbey, Friedman, Leedom & Ferguson; David S. Safran

[57] ABSTRACT

An idler device is for use in a lever-type winch having a brake including a hub fixed to a pinion shaft, an actuating member mounted on a threaded portion of the pinion shaft, and a ratchet wheel and two brake plates interposed between the hub and the actuating member; a lever mounted in such a way that it is pivotable about the axis of the pinion shaft; a changeover gear portion provided on the actuating member; and a changeover claw catch, mounted on the lever and provided with a claw for forward operation and a claw for reverse operation which are selectively engagable with and disengagable from the changeover gear portion of the actuating member. The idler device has a holding member rotatably mounted on the end of the pinion shaft; a rapid winding grip mounted on the pinion shaft between the actuating member and the holding member, the grip being mounted rotatably and in such a way that it is free to move in the axial direction; and a spring resistance member, fitted to the holding member and/or the rapid winding grip, which always acts to rotate the actuating member in the direction in which the actuating member relaxes the brake when the actuating member rotates.

7 Claims, 6 Drawing Sheets

LEVER-TYPE WINCH IDLER DEVICE

FIELD OF THE INVENTION

This invention relates to an idler device in a lever-type winch, and particularly relates to an idler device for rapidly adjusting the load chain to a desired length when there is no load on the winch.

BACKGROUND OF THE INVENTION

Conventionally, a lever-type winch is fitted with an idler device for unmeshing an intermediate driven gear from the pinion of the gearing-down mechanism and allowing the length of the load chain to be adjusted to a desired length when there is no load on the winch.

However, with a conventional lever-type winch idler device, because if the pinion is strongly pulled intentionally by users even when there is a load on the winch, the pinion can be pulled away from the intermediate driven gear when the load on the winch is not so heavy, there is a danger of the winch going into the idled state and the load being dropped.

Also, because conventional idler devices have a construction in which a pinion shaft formed as one body with the pinion is moved axially, the idler mechanism is large and complicated, and it is difficult to simply and quickly changeover to idled operation.

SUMMARY OF THE INVENTION

According to this invention, there is provided an idler device for a lever-type winch, the idler device having the following construction. In a lever-type winch having a brake including a hub fixed to a pinion shaft, an actuating member mounted on a threaded portion of the pinion shaft, and a ratchet wheel and brake plates interposed between the hub and the actuating member; a lever mounted in such a way that it is pivotable about the axis of the pinion shaft; a changeover gear portion provided on the actuating member; and a changeover claw catch mounted on the lever and provided with a claw for forward operation and a claw for reverse operation which are selectively engagable with and are disengagable from the changeover gear portion of the actuating member; the lever-type winch idler device comprises; a holding member (18) rotatably mounted on the end of the pinion shaft; a rapid winding grip mounted on the pinion shaft between the actuating member and the holding member, said grip being mounted rotatably and in such a way that it is free to move in the axial direction; a spring resistance member, fitted to at least one of the holding member and the rapid winding grip, which exerts a spring force on the actuating member in the direction that the actuating member is turned along the threaded position away from the brake and to relax said brake.

In a lever-type winch idler device according to this invention, the ends of the spring resistance member are fixed in a holding groove provided in the pinion shaft and a holding groove provided in the holding member and/or the rapid winding grip.

And, in a lever-type winch idler device according to this invention, the holding member is rotationally sprung by the spring resistance member, and the holding member and the rapid winding grip are linked to each other, by the mutual circumferential engagement of engaging grooves and engaging projections, so that they rotate together.

And, in a lever-type winch idler device according to this invention, the rapid winding grip and the actuating member are linked to each other, by the mutual circumferential engagement of engaging grooves and engaging projections, so that they rotate together.

According to another teaching of the invention, a lever-type winch idler device is provided with a means for putting the actuating member into a position in which the brake is relaxed for idled operation, a gap $\theta$ between the actuating member and the rapid winding grip to allow the actuating member to move along the pinion shaft in the direction in which it relaxes the brake when it moves, and a compression spring interposed between the actuating member and the rapid winding grip.

BRIEF DESCRIPTION OF THE DRAWINGS

FIG. 8(*b*) is a side elevation view of the spring resistance member; and

DETAILED DESCRIPTION OF THE PREFERRED EMBODIMENT

A preferred embodiment of the invention will now be described, with reference to the accompanying drawings.

Figure 1:
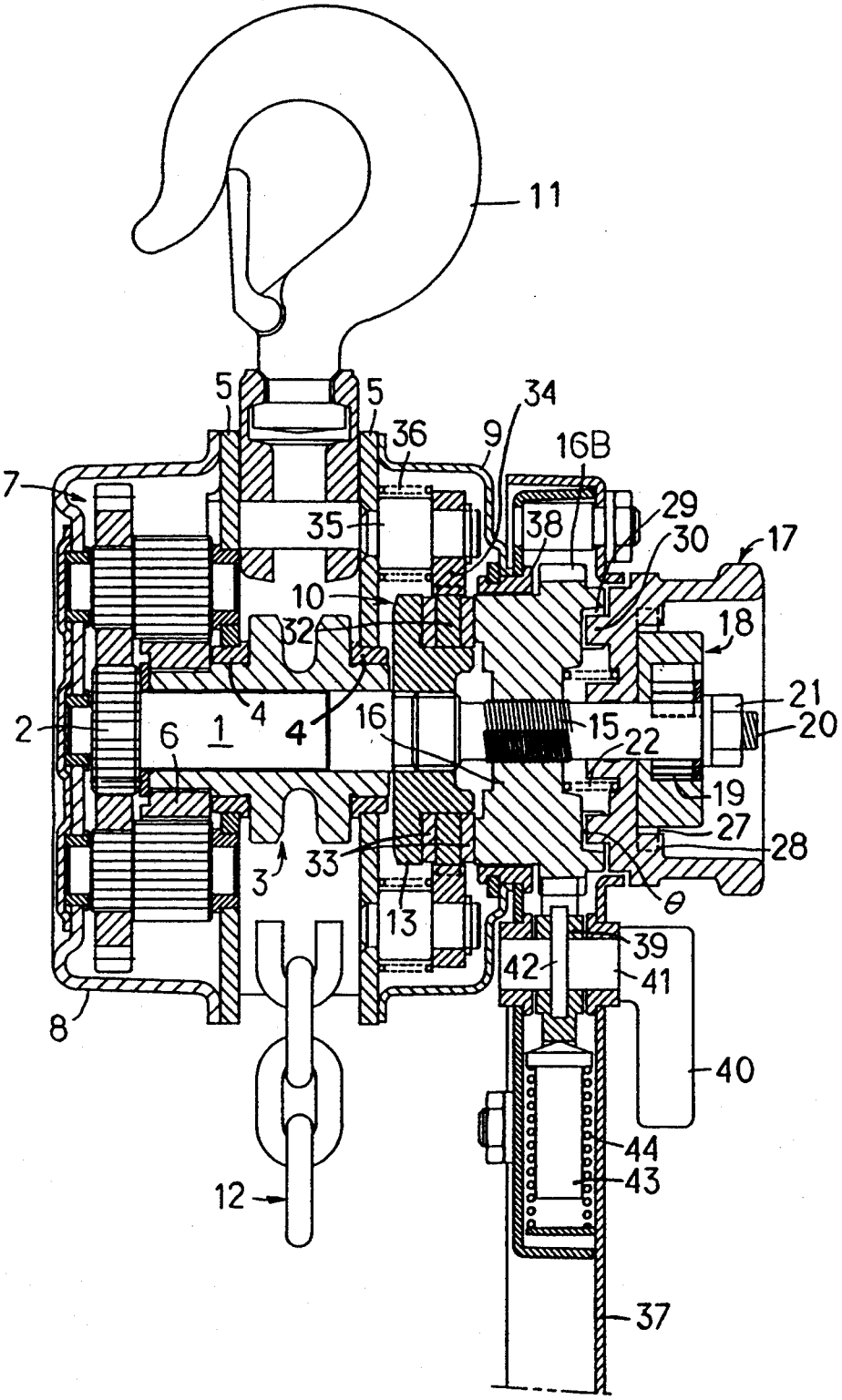
FIG. 1 is a vertical cross-sectional view of a level-type winch provided with an idler device according to a preferred embodiment of the invention.

As shown in FIG. 1, a pinion 2 is provided at one end of a pinion shaft 1, mounted as one body with the pinion shaft 1. A load sheave 3 is rotatably sheathed onto the pinion shaft 1, and this load sheave 3 is supported at each end by bearing metals 4,4 mounted in side plates 5,5. A gear 6 is fixed to the load sheave 3 and is permanently linked to the pinion 2 through a gear train 7. A gear case 8 is fixed to one of the side plates 5 and encloses the entire gear train 7, and a brake cover 9 is fixed to the other side plate 5 and encloses the entire brake section 10.

A top hook 11 is fitted to the side plates 5,5 in such a way that it is free to pivot about both of two perpendicular axes. A load chain 12 passes over and hangs from the load sheave 3, a bottom hook (not shown in the drawings) is fitted to the bottom end of the load chain 12, and the load is attached to the bottom hook.

A hub 13 is mounted on serration 14 on the pinion shaft 1 in such a way that it is not free to rotate with respect to the pinion shaft 1. An actuating member 16 is screwed onto a brake screw 15 provided on the pinion shaft 1, and a rapid winding grip 17 is mounted near the outer end of the pinion shaft 1, rotatably and in such a way that it can move in the axial direction. A holding member 18 is rotatably mounted on the outer end of the pinion shaft 1, and a spring resistance member 19 consisting of a coil spring is disposed between the holding member 18 and the pinion shaft 1.

A threaded shaft 20 is provided on the outer end of the pinion shaft 1, and a nut 21 screwed onto the threaded shaft 20 acts as a means keeping the holding member 18 on the pinion shaft 1.

A spring 22 is compressed between the actuating member 16 and the rapid winding grip 17, and the rapid winding grip is pressed against the holding member 18 by this spring at all times.

Figure 6:
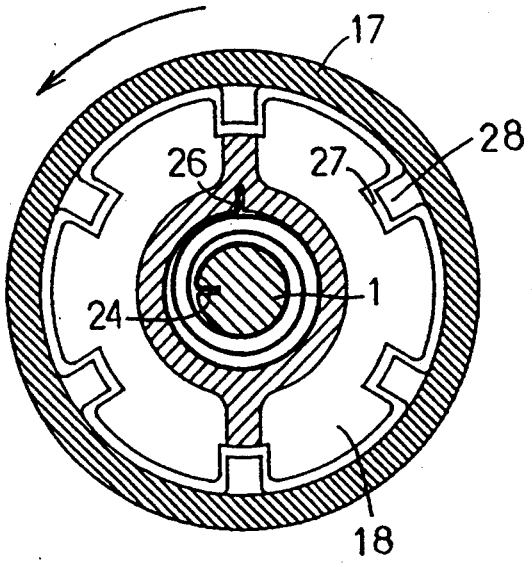
FIG. 6 is a cross-sectional view, taken along the line 6 in FIG. 2, showing how the holding member, pinion shaft, and spring resistance member are engaged.
Figure 8A:
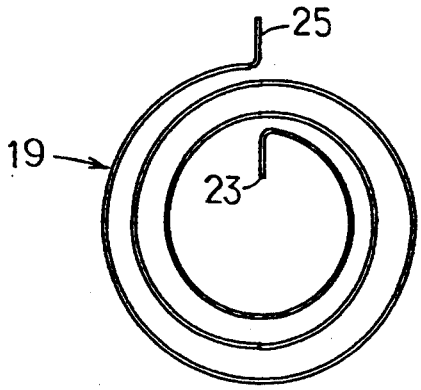
FIG. 8(*a*) is a front elevation view of the spring resistance member.
Figure 8B:
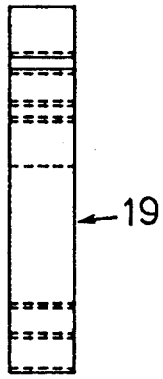

As shown in FIG. 8(*a*) and FIG. 8(*b*), the above-mentioned spring resistance member 19 consists of a coil spring made from a thin sheet of spring steel, and has a projection 23 at its inner end and a projection 25 at its outer end, and, as shown in FIG. 6, is mounted in a state in which it is somewhat wound-up, with the inner end projection 23 fitted into a holding groove 24 in the pinion shaft 1 and with the outer end projection 25 fitted into a holding groove 26 in the holding member 18. Round spring steel can alternatively be used for the coil spring resistance member 19, and various other constructions not shown in the drawings can be employed for this part.

Figure 2:
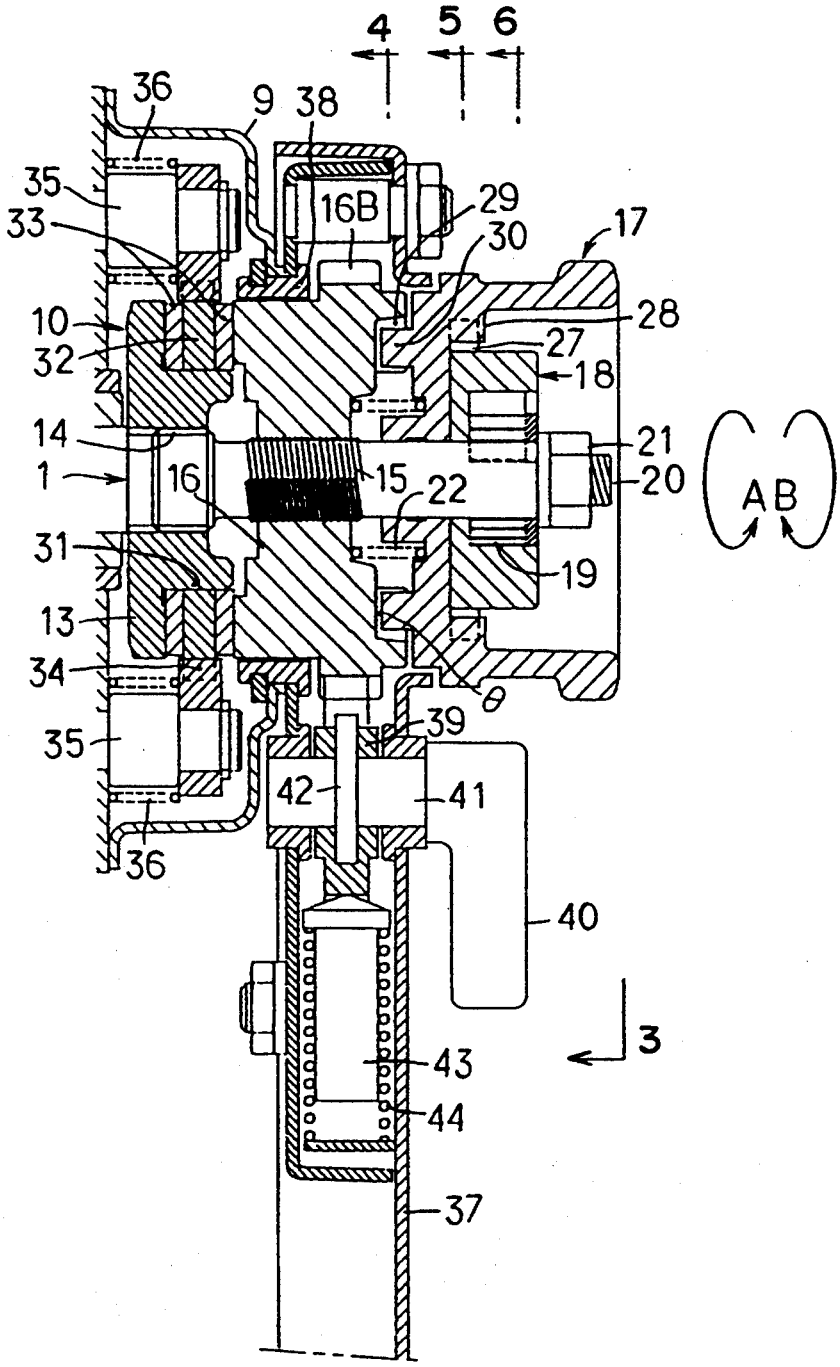
FIG. 2 is an enlarged cross-sectional view of the idler device shown in FIG. 1.

As shown in FIG. 2 and FIG. 6, the holding member 18 is provided with holding grooves 27 in its periphery and the rapid winding grip 17 is provided with holding projections 28 on its inner surface, and these holding projections 28 mate with the holding grooves 27 so that the holding member 18 and the rapid winding grip 17 are linked together in the circumferential direction and rotate together.

Figure 4:
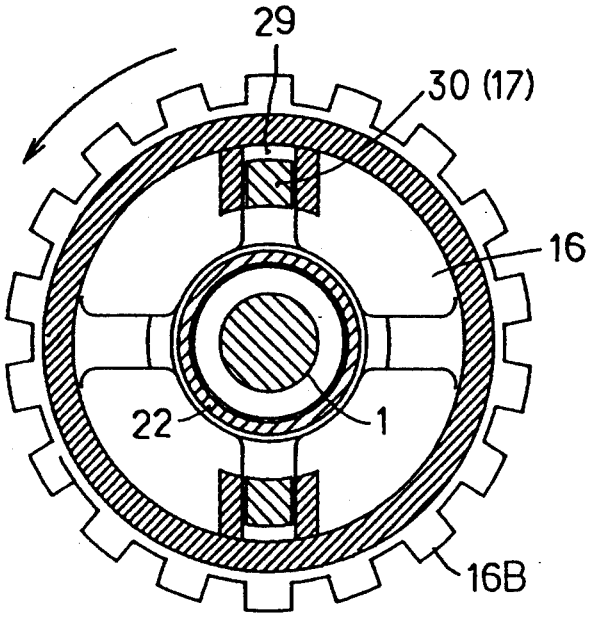
FIG. 4 is a cross-sectional view, taken along the line 4 in FIG. 2, showing the engaging parts which link the actuating member to the rapid winding grip.
Figure 5:
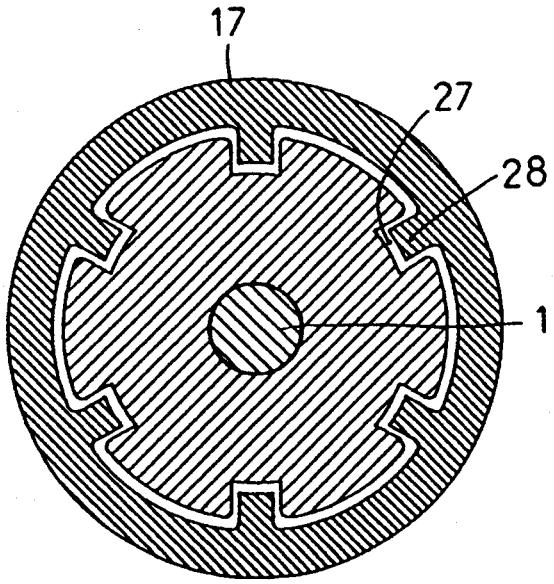
FIG. 5 is a cross-sectional view, taken along the line 5 in FIG. 2, showing the engaging parts which link the holding member to the actuating member.

As shown in FIG. 2 and FIG. 4, the actuating member 16 is provided with holding grooves 29 and the rapid winding grip 17 is provided with holding projections 30, and these holding projections 30 mate with the holding grooves 29 so that the actuating member 16 and the rapid winding grip 17 are linked together in the circumferential direction and rotate together.

A brake section 10 includes said hub 13 unrotatably fitted on the pinion shaft 1, a ratchet wheel 32 and a pair of brake linings 33,33 which are sheathed onto a small diameter portion 31 of the hub 13, and said actuating member 16.

The ratchet wheel 32 is engaged with a pair of braking claws 34,34 which are supported on claw pins 35,35 of the side plate 5 and pushed on the ratchet wheel by springs 36,36.

During brake operation, a gap $\theta$ exists between the actuating member 16 and the rapid winding grip 17.

As shown in FIG. 2, in the lever part of the winch, a lever 37 is pivotally mounted on a brake cover 9 by means of a large bearing metal 38. Although this lever 37 is positioned around the actuating member 16, the actuating member 16 and the lever 37 are completely independent of each other.

Figure 3:
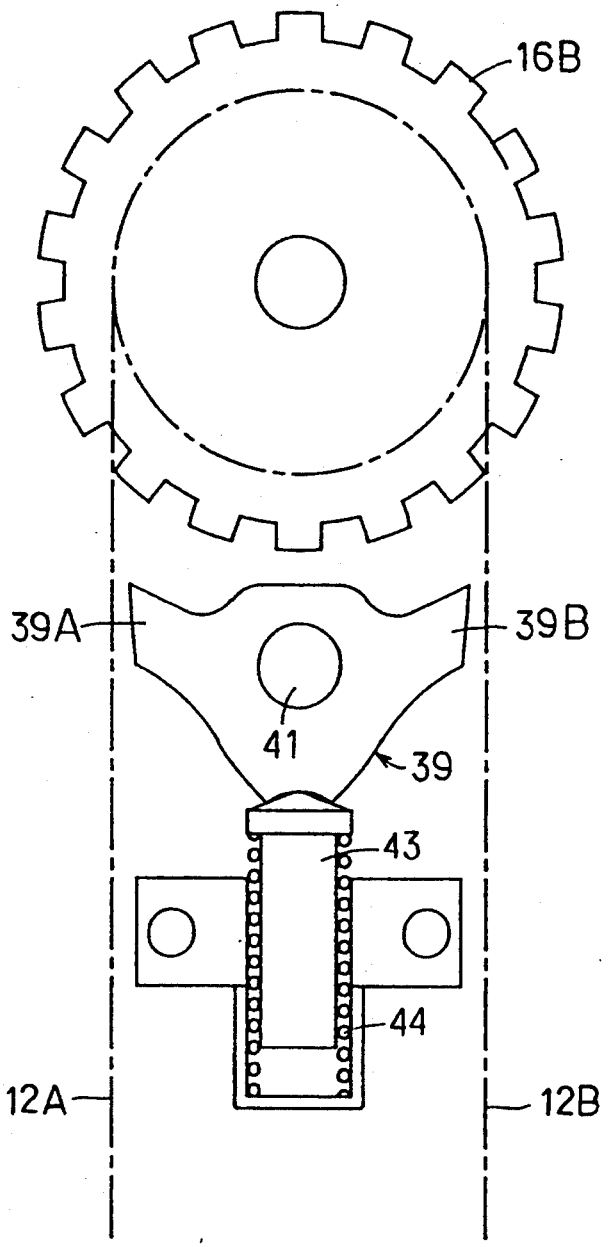
FIG. 3 is a front elevation view of the lever changeover claw catch shown in FIGS. 1 and 2, seen from the direction indicated by the arrow 3 in FIG. 2.

As shown in FIG. 2 and FIG. 3, a changeover gear portion 16B is provided on the periphery of the actuating member 16, and the forward claw 39A and the reverse claw 39B of a changeover claw catch 39 are positioned in such a way that they can be selectively engaged with the changeover gear portion 16B. This changeover catch 39 is fixed to the shaft 41 of a handle 40 by a spring pin 42, and the shaft 41 is pivotally mounted on the lever 37. A holding rod 43 for holding the changeover claw catch 39 in its selected position is mounted on the lever 37, and this holding rod 43 is pushed against the changeover claw catch 39 by a spring 44 and holds the changeover claw catch 39 in whichever of the positions forward, reverse, or neutral is selected by the operator by turning the handle 40.

The operation of the preferred embodiment described above will now be mentioned.

Figure 9A:
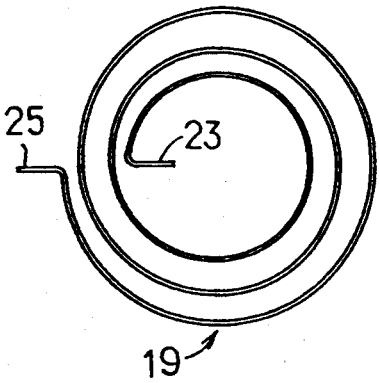
FIG. 9(*a*) is a front elevation view showing the state of the spring resistance member before it is fitted to the idler device, and FIG. 9(*b*) is a front elevation view showing the state of the spring resistance member after it is fitted to the idler device.
Figure 9B:
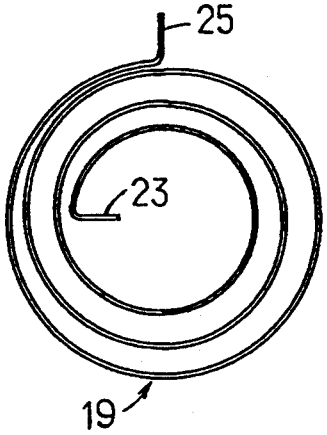

In the no-load state, the spring resistance member 19 lies between the pinion shaft 1 and the holding member 18 in a state in which it has been wound up, with consequent elastic energy accumulation, from its pre-assembly state as shown in FIG. 9(*a*), into its post-assembly state as shown in FIG. 9(*b*), so that it exerts a turning force on the holding member 18 relative to the pinion shaft 1 in the direction indicated by the arrow in FIG. 6. Because the holding grooves 27 in the periphery of the holding member 18 are interlocked with the holding projections 28 on the rapid winding grip 17, and the holding projections 30 on the rapid winding grip 17 are interlocked with the holding grooves 29 in the actuating member 16, the actuating member 16 is continually subject to a positioning turning force in the direction indicated by the arrow in FIG. 4; the actuating member 16 is turned along the screw 15 away from the brake lining 33, pressure on the brake is avoided, and the brake is released.

Idler manipulation is performed in the no-load state. In order to manipulate the idler, the handle 40 is put into the neutral position so that the changeover claw catch 39 is brought clear of the gear portion 16B of the actuating member 16, as shown in FIG. 3. When the load chain 12A on the load side of the winch is then pulled, the motion is transmitted through the load sheave 3 and the gear train 7 to the pinion shaft 1, the pinion shaft 1 is rotated in the direction shown by the arrow A in FIG. 2, and with this rotation the transport action of the screw 15 causes the actuating member 16 to move slightly toward the hub 13. However, because the changeover claw catch 39 is in the neutral position and the actuating member 16 is rotating in isolation from and independently of the lever 37, the tightening force exerted by the actuating member 16 on the brake is minute.

Because the motion of the actuating member 16 toward the hub 13 takes place against the elastic resistance of the spring resistance member 19, rotation of the actuating member 16 relative to the hub 13 is suppressed, and the exertion of a tightening force on the brake is avoided. As a result, the load side 12A of the load chain can be drawn out rapidly.

When the non-load side 12B of the load chain is pulled, the motion is transmitted from the load sheave 3 through the gear mechanism to the pinion shaft 1 and the pinion shaft 1 is rotated in the direction shown by the arrow B in FIG. 2. When this happens, because a gap $\theta$ is provided between the actuating member 16 and the rapid winding grip 17 to permit the actuating member 16 to move away from the brake, the actuating member 16 moves freely from the hub 13 under the transporting action of the screw 15 is given. As a result, in the no-load state, simply pulling the non-load side 12B of the load chain will make possible to spin the load sheave 3 freely, and the load side 12A of the load chain can be rapidly shortened.

When there is a light load acting on the load side 12A of the load chain and the handle 40 is set to the neutral position, the spring 22 which maintains the gap $\theta$ between the actuating member 16 and the rapid winding grip 17 prevents the load side 12A of the chain slipping due to the insufficient tightening torque on the brake section 10. That is to say, the reaction force of the spring 22 acts to help the actuating member 16 to operate the brake 10, then the slippage of the load side 12A is prevented.

In all the cases discussed above, when manipulating the idler, simply setting the handle 40 to the neutral position enables either the load side chain 12A or the non-load side chain 12B to be swiftly shortened, and a kind of automatic idler device is realized.

Figure 7:
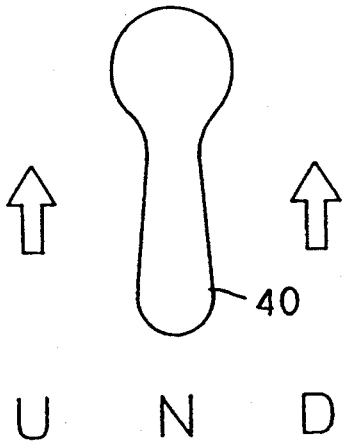
FIG. 7 is a view illustrating the different setting positions of the handle shown in FIG. 1.

To lift or haul a load, the handle 40 is set into the position U shown in FIG. 7 and the lever 37 is swung back and forth. The forward claw 39A of the changeover claw catch 39 engages with the changeover gear portion 16B and rotates the actuating member 16, and because the actuating member 16 is moved toward the hub 13 by a thrust greater than the reaction force of the spring resistance member 19, tightening the brake section 10, normal lifting or hauling can be carried out.

To lower or return a load, the handle 40 is set to the position D shown in FIG. 7. The reverse claw 39B of the changeover claw catch 39 engages with the changeover gear portion 16B and, in the same way as in the lifting and hauling case described above, as long as the load is there the actuating member 16 is moved toward the hub 13 and tightens the brake section 10, and normal lowering or returning can be performed by swinging the lever 37.

Also, when the changeover claw catch 39 is set into the neutral position while a load is being hoisted, because the actuating member 16 is tightening the brake section 10 with a thrust greater than the reaction force of the spring resistance member 19, idler operation is impossible and safety is maintained.

EFFECTS OF THE INVENTION

In a lever-type winch constructed according to this invention, a holding member 18 engages with a rapid winding grip 17 which engages with an actuating member 16, and because a spring resistance member 19 is positioned between the holding member 18 and the pinion shaft 1 and the actuating member 16 is always subject to the force of the spring resistance member 19 acting on the actuating member 16 in the opposite direction to that in which the actuating member 16 tightens the brake section when it moves, when there is no load on the winch and the changeover claw catch 39 is set to the neutral position and the load side 12A of the load chain 12 is pulled, the actuating member 16 is prevented from tightening the brake so that the load side 12A of the load chain 12 can be rapidly extended with the pinion shaft in continuous forward rotation.

Because the elastic force of the spring resistance member 19 acts on the actuating member 16 in the direction in which the actuating member 16 relaxes the brake when it moves, even a spring resistance member 19 of very small elastic force will give the required rotational resistance to the actuating member 16, and therefore the invention has the advantage that the spring resistance member 19 can be small.

And, because a gap $\theta$ is provided between the actuating member 16 and the rapid winding grip 17 to allow the actuating member 16 to move away from the brake, the actuating member 16 is moved by the transporting action of the brake screw 15 away from the side of the hub 13, when the non-load side 12B of the load chain 12 is pulled to rotate the pinion shaft 1 in reverse when there is no load on the winch. In other words, the actuating member 16 relaxes the brake and decreases the size of the gap $\theta$ as far as such rotation of the pinion shaft 1 is continued, it is possible simply by pulling the non-load side 12B of the load chain 12 to rapidly shorten the load side 12A of the load chain 12.

When there is a load acting on the load side 12A of the load chain 12, because the actuating member 16 tightens the brake section 10 with a thrust that is greater than the reaction force of the spring resistance member 19, the winch will not go into the idled state during operation, and safe operation is ensured.

With this invention, unlike conventional idler devices requiring complicated constructions and operating procedures, just by mounting a spring resistance member 19 on the pinion shaft 1, the operation to draw the actuating member 16 away from the brake is carried out, a kind of automatic idler device is created, and various desirable benefits such as a simple construction, a small number of parts, and low manufacturing cost, can be realized.

What is claimed is:

1. A lever-type winch idler device in a lever-type winch having a brake (10) including a hub (13) fixed to a pinion shaft (1), an actuating member (16) mounted on a threaded portion (15) of the pinion shaft (1), and a ratchet wheel (32) and brake plates (33,33) interposed between the hub (13) and the actuating member (16); a lever (37) mounted in such a way that it is pivotable about the axis of the pinion shaft (1); a changeover gear portion (16B) provided on the actuating member (16); and a changeover claw catch (39) mounted on the lever (37) and provided with a claw (39A) for forward operation and a claw (39B) for reverse operation which are selectively engagable with and disengagable from the changeover gear portion (16B) of the actuating member (16); the lever-type winch idler device comprising;

a holding member (18) rotatable mounted on the end of the pinion shaft (1);

a rapid winding grip (17) mounted on the pinion shaft (1) between the actuating member (16) and the holding member (18), said grip (17) being mounted rotatably and in such a way that it is free to move in the axial direction;

a spring resistance member (19) mounted on at least one of the holding member (18) and the rapid winding grip (17), said spring resistance member being positioned for exerting a spring force on the actuating member (16) in a direction that the actuating member (16) is rotatable along the threaded portion (15) away from the brake (10) as a means for relaxing said brake (10).

2. A lever-type winch idler device according to claim 1, in which the ends of the spring resistance member (19) are held in a holding groove (24) provided in the pinion shaft (1) and a holding groove (26) provided in one of the holding member (18) and the rapid winding grip (17).

3. A lever-type winch idler device according to claim 2, in which the spring resistance member (19) is positioned between the holding member (18) and the pinion shaft (1) for exerting spring force on the holding member (18), and the holding member (18) and the rapid winding grip (17) are linked by a first engaging groove (27) and engaging projection (28) arrangement formed in facing surfaces thereof, so that they rotate together.

4. A lever-type winch idler device according to claim 3, in which the rapid winding (17) and the actuating member (16) are linked by a second engaging groove (29) and engaging projection (30) arrangement formed in facing surfaces thereof, so that they rotate together.

5. A lever-type winch idler device according to claim 1, further comprising:

a compression spring (22) interposed between the actuating member (16) and the rapid winding grip (17); wherein a gap ($\theta$) is provided between the actuating member (16) and the rapid winding grip (17) to allow the actuating member (16) to move along the pinion shaft (1) in the direction in which the actuating member (16) relaxes the brake (10) when it moves.

6. A lever-type winch idler device according to claim 1, in which the spring resistance member (19) is positioned between the holding member (18) and the pinion shaft (1) for exerting spring force on the holding member (18), and the holding member (18) and the rapid winding grip (17) are linked by a first engaging groove (27) and engaging projection (28) arrangement formed in facing surfaces thereof, so that they rotate together.

7. A lever-type winch idler device according to claim 6, in which the rapid winding grip (17) and the actuating member (16) are linked by a second engaging groove (29) and engaging projection (30) arrangement formed in facing surfaces thereof, so that they rotate together.

* * * * *